US006703145B1

(12) United States Patent
Samuelsson

(10) Patent No.: US 6,703,145 B1
(45) Date of Patent: Mar. 9, 2004

(54) PROCESS FOR ELECTROLYTIC COATING OF A SUBSTRATE AND PRODUCT PRODUCED

(75) Inventor: Per Samuelsson, Partille (SE)

(73) Assignee: Koncentra Holding AB, Mölnlycke (SE)

( * ) Notice: Subject to any disclaimer, the term of this patent is extended or adjusted under 35 U.S.C. 154(b) by 0 days.

(21) Appl. No.: 09/936,894

(22) PCT Filed: Mar. 13, 2000

(86) PCT No.: PCT/SE00/00496

§ 371 (c)(1),
(2), (4) Date: Sep. 27, 2001

(87) PCT Pub. No.: WO00/56953

PCT Pub. Date: Sep. 28, 2000

(30) Foreign Application Priority Data

Mar. 19, 1999 (SE) ..... 9900994

(51) Int. Cl.[7] ..... C25D 15/02; F16J 9/26

(52) U.S. Cl. ..... 428/666; 205/109; 205/113; 277/444; 428/667

(58) Field of Search ..... 205/109, 110, 205/113, 319; 428/666, 667; 277/444

(56) References Cited

U.S. PATENT DOCUMENTS 4,160,707 A * 7/1979 Helle et al. ..... 205/109
4,846,940 A 7/1989 Neuhäuser et al.
4,886,583 A * 12/1989 Martinou et al. ..... 205/109
6,054,225 A * 4/2000 Harayama et al. ..... 428/667

FOREIGN PATENT DOCUMENTS

| | | |
|---|---|---|
| EP | 0 573 918 A1 | 12/1993 |
| EP | 0 668 375 A1 | 8/1995 |
| EP | 0 841 413 A1 | 5/1998 |
| JP | 8-325794 | 12/1996 |

* cited by examiner

*Primary Examiner*—Roy King
*Assistant Examiner*—William T. Leader
(74) *Attorney, Agent, or Firm*—Burns, Doane, Swecker & Mathis, L.L.P.

(57) ABSTRACT

The present invention relates to a process for electrolytic coating of a substratum, especially a piston ring, with a ceramic chrome layer, the substratum being arranged at an electrode connected to voltage and chromium ions for coating the substratum being present in the electrolyte. Furthermore the electrolyte contains a crystalline carrier structure which is present in the form of ions in the electrolyte, said carrier structure acting as a carrier of the chromium ions which are present in the electrolyte, and being incorporated in the ceramic chrome layer forming on the substratum by the process. The invention also relates to a ceramic chrome layer which is applied to a substratum, especially a piston ring, and is characterised in that the chrome layer is formed by a process as stated above and comprises a crystalline carrier structure.

20 Claims, 3 Drawing Sheets

PROCESS FOR ELECTROLYTIC COATING OF A SUBSTRATE AND PRODUCT PRODUCED

FIELD OF THE INVENTION

The present invention relates to a process for electrolytic coating of a substratum, especially a piston ring, with a ceramic chrome layer, the substratum being arranged at an electrode connected to voltage and chromium ions for coating the substratum being present in the electrolyte.

BACKGROUND ART

Products that are subjected to severe strain in the form of friction, heating, corrosive environment etc have for a long time been coated with different types of hard chromium plating, which are usually most resistant to abrasion and other kinds of wear. Such platings are used for cutting tools, their strength towards other materials being maximised. In certain cases however, such as in connection with piston rings for diesel engines, the problem arises that the plating of the ring must be resistant to abrasion but at the same time not so hard as to damage the cylinder lining in the cylinder in which the piston ring runs. Piston rings operating in, for example, a diesel engine are subjected to extreme strain in the form of, for example, high temperatures, stress in the actual piston ring material and friction against the cylinder lining. At the same time strict requirements are placed on reliability in operation when used in engines in shipping.

For instance, EP-0 668 375 discloses a method for making a durable coating for e.g. piston rings. By means of the method according to the above-mentioned patent document, a hard chrome layer forms, which also contains non-metallic particles, on the piston ring. These particles preferably consist of aluminium oxide but also carbides or nitrides may be used. The non-metallic particles are incorporated in the chrome layer with a view to increasing its durability. Such a hard chrome layer, which contains both chromium and non-metallic particles, is in this context referred to as a ceramic chrome layer. The great durability of the ceramic chrome layer is in particular necessary in the abrasion that typically occurs as metallic surfaces are made to slide against each other at a high temperature, such as when a piston ring in operation slides against the corresponding cylinder lining. According to the method described in the above-mentioned patent specification, a first layer of the plating is formed by means of an electrolyte in the form of a chrome bath of a type known to those skilled in the art, in which the substratum (in this case the piston ring) is kept at a constant electric potential. In this way a first layer forms on the substratum, containing chromium only. Subsequently at least one additional layer forms over the first, using an electrolytic bath which in addition to chromium contains non-metallic particles which are in suspension. When coating with the second layer, the substratum is kept at a varying electric potential by a pulsating, cyclically varying cathode current being supplied. The current and the voltage at the substratum vary in time between a maximum and a minimum value. This means that the ceramic chrome layer forms during a varying supply of ions to the layer. When the substratum to be coated with a chrome layer is connected to a high negative voltage (cathode voltage) the chrome layer will grow and become thicker. When the substratum is connected to a low negative voltage, the cracks in the chrome layer, which arise naturally in the layer of the surface, will widen. The particle which is to be incorporated in the layer, usually $Al_2O_3$, can at the next reversal of current penetrate into the widened cracks. The ceramic chrome layer which then arises will exhibit cracks, so-called microcracks, the non-metallic particles being incorporated both in and outside the microcracks, i.e. in the actual matrix.

In the above-mentioned process, it is mentioned as an advantage that the inclusion of the non-metallic particles restricts the incorporation of hydrogen in the plating. Hydrogen from the electrolytic liquid is incorporated to a greater or smaller extent in the plating in most electrolytic processes. The presence of hydrogen generally means a weakening of the material since the hydrogen "boils" out from the material at high temperatures. As the hydrogen disappears, the structure of the material collapses, thus weakening the plating. This is disadvantageous in connection with piston rings since boiling out often occurs even at temperatures of 200–300 degrees Celsius while the piston ring must resist surface temperatures of up to 400–500 degrees Celsius.

The non-metallic particle which normally is used in connection with this method is aluminium oxide ($Al_2O_3$). This ceramic is insoluble in the electrolytic liquid, which means that stirring of the electrolyte must occur continuously to keep the particles floating in suspension. This is a relatively difficult process since the electrolytic baths used often have a considerable volume. The aluminium oxide is in an electrically neutral state in the electrolytic liquid, which means that it is not affected by the electric field that arises between the anode and the cathode. The fact that aluminium oxide is still incorporated in the plating probably depends on oxide particles in the vicinity of the substratum being swept along by the chromium ions as they travel towards the substratum which is connected to the cathode.

SUMMARY OF THE INVENTION

The above drawbacks are obviated by the electrolyte in a process as described by way of introduction comprising a crystalline carrier structure which is present in the form of ions in the electrolyte, said carrier structure acting as a carrier of the chromium ions which are present in the electrolyte, and the carrier structure being incorporated in the ceramic chrome layer forming by means of the process. By carrier structure is here meant a compound or a substance in crystalline form, which forms ions in the electrolyte so as to be able to bind the chromium ions dissolved in the electrolyte. Both the chromium ions and the carrier structure thus travel under the action of the electric field between anode and cathode to the substratum. The carrier structure is thus incorporated in the coating layer where it acts as a reinforcement of the coating.

A suitable carrier structure is a so-called zeolite. Zeolites are chemical compounds consisting of, inter alia, aluminium, silicon and oxygen atoms which form a structure in the form of three-dimensional networks which give rise to a set of channels and voids. Zeolites are today mainly used for cracking of crude oil, i.e. as catalysts for decomposition of large hydrocarbon molecules, thus as a so-called molecular sieve. In the channels and voids of the zeolite, the positive ions are bound to the structure by applying weak electric forces. Thus these ions are apt to leave the zeolite which then forms a zeolite ion with sites to bind other, positively charged ions. This property makes it theoretically possible to use zeolites as ion exchangers. However, this has previously not been of any considerable practical use since zeolites are normally weak structures which are decomposed in strongly acid or basic solutions.

One more reason why zeolites have not been used in prior-art technique in this field is their excellent capability of adsorbing water and also binding hydrogen in their structure. Since the amount of hydrogen according to prior art should be as small as possible in the coating, this property thus give the zeolites a drawback at first sight.

According to the present invention, zeolite can be used as a carrier structure and, consequently both as a carrier of chromium ions to the substratum, and as a ceramic particle included in the chrome layer to reinforce the coating. The sites of the zeolite ion are well suited for taking up chromium ions and, when binding thereto, they will be a positively charged unit, which is attracted by the substratum connected to the negatively charged cathode. This double function as a carrier and as a reinforcing material gives essential advantages over prior art. The coating process is thus simplified to a considerable extent and requires less consumption of energy than conventional methods in the field.

In the inventive process, the substratum can be kept at an essentially constant electric potential. This is possible since the carrier structure will be not be neutral in solution in the same way as previously used ceramics. It is instead the carrier structure's own electric charge that binds chromium ions in the electrolyte. In the case of zeolites as a carrier structure, it is the zeolite's own positive and loosely bound ions that are exchanged for the chromium ions in the electrolyte, which results in a positively charged, chromium-saturated zeolite.

The inventive process is thus significantly simplified compared with prior-art processes in that current variation is not necessary either.

An acid-stable carrier structure is suitably used in the process. By acid stable is here meant that it resists pH<1 without the crystal structure decomposing. Such synthetic zeolites are today available although they are relatively untried in this context.

The carrier structure used should also be thermally stable to withstand the stress in e.g. the outer layer of a piston ring. Depending on structure and on which chrome bath is used, the carrier structure can act as a carrier of trivalent as well as hexavalent chromium ions.

A zeolite which is available under the name ZSM-5 EZ 472 and sold by, inter alia, Akzo Nobel has been found particularly advantageous.

The present invention also comprises a ceramic chrome layer which is arranged on a substratum, especially a piston ring, characterised in that the chrome layer is formed by the above-mentioned process and comprises a carrier structure.

The zeolite embedded in the chrome layer here serves as reinforcement and improves the durability of the layer, without being so hard as to risk damaging the surface against which the layer is being worn.

The carrier structure suitably appears both in the underlying matrix of the layer and in its network of primary cracks arising at the surface.

This carrier structure can advantageously be a zeolite whose properties have been described above. In particular, zeolites of the type MFI structure (Mobile Five) have been found convenient for the accomplishment of the invention.

Moreover the carrier structure is advantageously acid stable and thermally stable for the same reasons as mentioned when describing the process. In the coating the barrier structure can also be bound to both trivalent and hexavalent chromium ions.

Hydrogen can advantageously be bound in the carrier structure in such manner that the hydrogen is prevented from boiling out at an increase in temperature of the layer. The hydrogen which the carrier structure entrains into the coating from the electrolytic bath has been found to be differently incorporated in the coating, compared with the hydrogen which unintentionally went along into the chrome layers in other electrolytic methods. In the dislocations of the chromium crystal the hydrogen is more firmly bound in the layer and thus does not boil out at high temperatures, but contributes to making the chrome layer more thermally stable.

DESCRIPTION OF A PREFERRED EMBODIMENT

As a starting point when carrying out the process, use is suitably made of a chromium bath based on either $Cr^{3+}$ or $Cr^{6+}$ as electrolyte. Convenient catalysts are $SO_4(2-)$, $F^-$ or some other organic acid, such as citric acid. Suitable proportions are, for example, 200–300 g/l $Cr^{6+}$, 50–60 g/l $Cr^{3+}$, 1.5–3.0 g/l $SO_4$, 1–2 g/l $F^-$ and 5–20 g/l organic acid. The concentration of zeolite is preferably 10–100 g/l and the bath temperature 50–60 degrees Celsius. The current density to the cathode to which the substratum is connected can conveniently be 40–80 A/dm$^2$, and preferably 50–70 A/dm$^2$.

Figure 1:
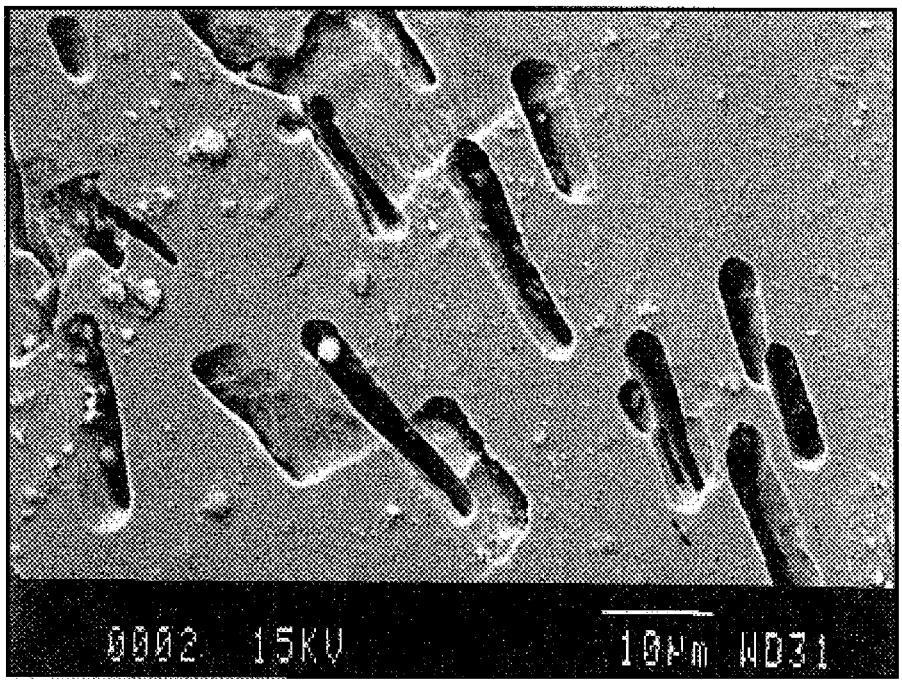
FIG. 1 is an SEM picture of a coating according to the invention.

FIG. 1 is an SEM picture of the surface of an embodiment of a coating according to the invention. The primary crack network is here clearly to be seen in the matrix. In the picture, the zeolites are to be seen as granular particles in the cracks as well as in the matrix.

Figure 2:
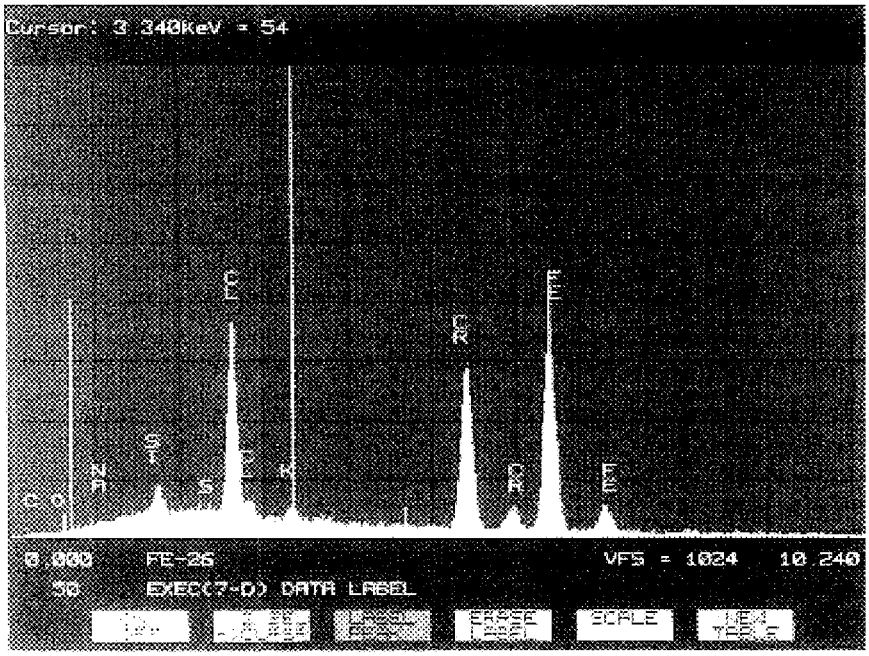
FIG. 2 illustrates a spectral analysis of the distribution of substances in a coating according to the invention.

FIG. 2 shows the result of a spectral analysis of a coating according to an embodiment of an invention. The distribution of substances is clearly to be seen with peaks of e.g. chromium and iron.

Figure 3:
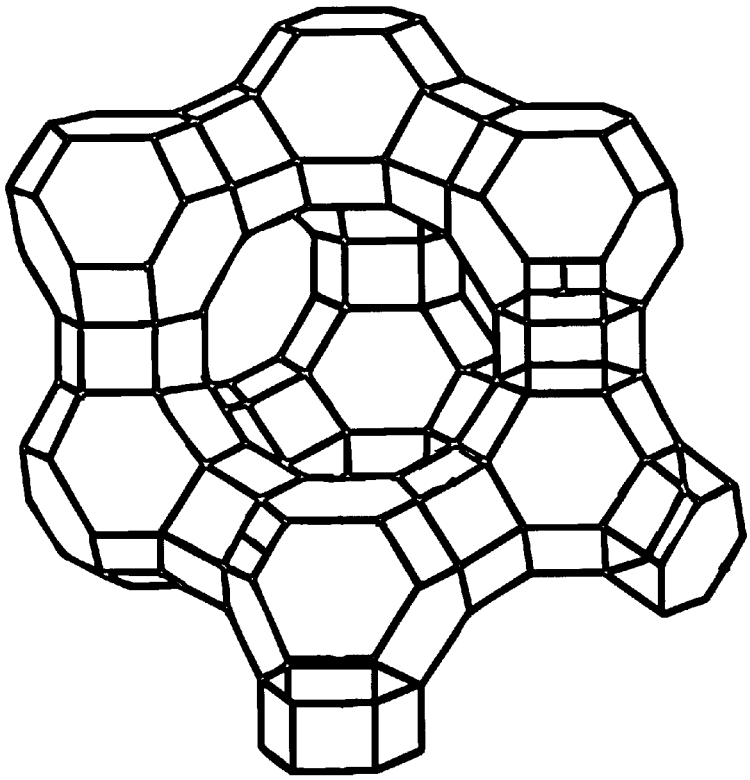
FIG. 3 illustrates an example of a zeolitic structure.

FIG. 3 illustrates an example of a zeolitic structure. Typical of these are the ion sites where ion exchange can take place and the void formed in the centre, in which hydrogen is usually incorporated when the zeolite is dissolved in a liquid containing water, such as an electrolytic liquid.

Figure 4:
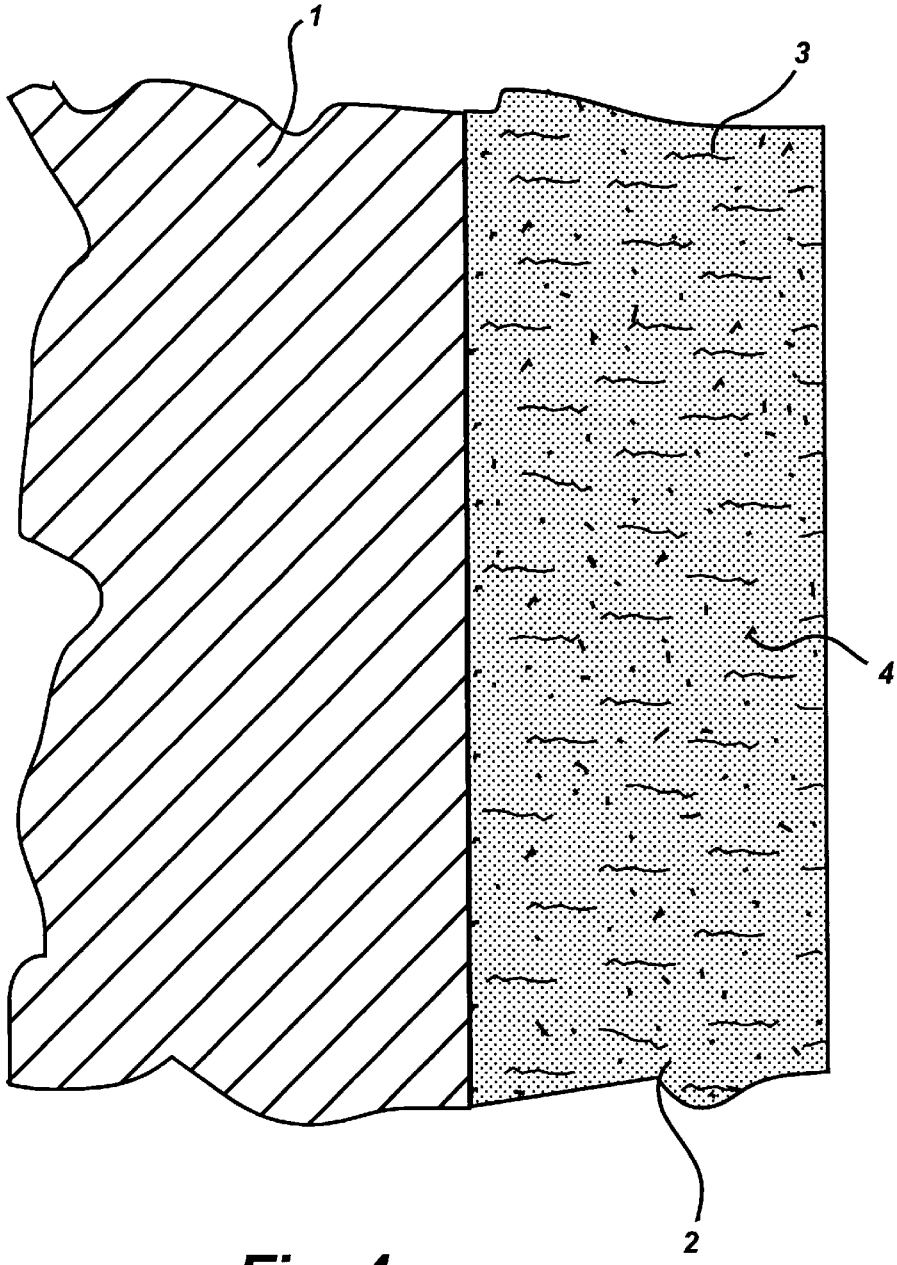
FIG. 4 illustrates schematically a coating according to the invention.

FIG. 4 is a schematic view of a coating according to the invention. A substratum consisting of cast iron 1 forms the base to which the coating is fixed. The coating forms a hard chromium matrix 2 which contains non-metallic, dispersed particles, i.e. zeolites. Such a zeolite is designated 4 in FIG. 4. In the hard chromium matrix 2 there are microcracks 3 which form in the coating process. The microcracks 3 are partly filled with zeolite particles in the same way as the matrix 2.

A coating prepared according to the above method has been found to have resistance in dry abrasion corresponding to that of ceramic chromium in four-stroke engines. Its thermal resistance is equivalent to plasma or better. The adhesiveness to the substratum has been found equivalent to hard chromium or better, just like its passiveness in a strongly corrosive environment.

By means of the inventive, significantly simplified process, a ceramic chrome coating thus is provided, whose properties correspond to the currently available coatings, or are even superior to those.

What is claimed is:

1. A process for electrolytic coating of a substratum with a ceramic chrome layer, the substratum being arranged at an electrode connected to voltage and chromium ions for coating the substratum being present in the electrolyte wherein the electrolyte comprises a crystalline carrier structure which is present in the form of ions in the electrolyte, said carrier structure acting as a carrier of the chromium ions which are present in the electrolyte, and the carrier structure being incorporated in the ceramic chrome layer forming on the substratum by means of the process.

2. The process as claimed in claim 1 wherein said carrier structure is a zeolite.

3. The process as claimed in claim 2 wherein the zeolite is of the MFI type structure.

4. The process as claimed in claims 1 wherein the substratum is kept at an essentially constant electric potential while the ceramic chrome layer forms on the substratum.

5. The process as claimed in claim 1 wherein the carrier structure used is acid stable.

6. The process as claimed in claim 1 wherein the carrier structure used is thermally stable.

7. The process as claimed in claim 1 wherein the carrier structure used acts as a carrier of $Cr^{3+}$.

8. The process as claimed in claim 1 wherein the carrier structure used acts as a carrier of $Cr^{6+}$.

9. The process as claimed in claims 1 wherein said substratum is a piston ring.

10. The ceramic chrome layer which is applied to a substratum wherein the chrome layer is formed by means of the process according to claim 1 and comprises a crystalline carrier structure.

11. The ceramic chrome layer as claimed in claim 10 wherein the carrier structure is a zeolite.

12. The ceramic chrome layer as claimed in claim 11 wherein the zeolite is of the type MFI structure.

13. The ceramic chrome layer as claimed in claim 11 wherein the carrier structure is present in the underlying matrix of the layer as well as a network of primary cracks formed at the surface.

14. The ceramic chrome layer as claimed in claim 10 wherein the carrier structure is present in the underlying matrix of the layer as well as a network of primary cracks formed at the surface.

15. The ceramic chrome layer as claimed in claim 10 wherein the carrier structure is acid stable.

16. The ceramic chrome layer as claimed in claim 10 wherein the carrier structure is thermally stable.

17. The ceramic chrome layer as claimed in claim 10 wherein the carrier structure is chemically bound to $Cr^{3+}$ ions.

18. The ceramic chrome layer as claimed in claim 10 wherein the carrier structure used is chemically bound to $Cr^{6+}$ ions.

19. The ceramic chrome layer as claimed in claim 10 wherein hydrogen is bound in the carrier in such manner that the hydrogen is prevented from boiling out at an increase in temperature of the layer.

20. The ceramic chrome layer as claimed in claim 10 wherein said substratum is a piston ring.

* * * * *